US006322005B1

(12) United States Patent
Kern et al.

(10) Patent No.: US 6,322,005 B1
(45) Date of Patent: Nov. 27, 2001

(54) SHOWER SYSTEM WITH ADJUSTABLE STREAMS

(75) Inventors: Peter Kern, Stuttgart; Rainer Schopp, Reutlingen; Wilhelm Bauer, Stuttgart; Andreas Frede, Gerlingen, all of (DE)

(73) Assignee: Fraunhofer-Gesellschaft zur Förderung der angewandten Forschung e.V. (DE)

( * ) Notice: Subject to any disclaimer, the term of this patent is extended or adjusted under 35 U.S.C. 154(b) by 0 days.

(21) Appl. No.: 09/509,628

(22) PCT Filed: Oct. 1, 1998

(86) PCT No.: PCT/EP98/06253

§ 371 Date: Mar. 30, 2000

§ 102(e) Date: Mar. 30, 2000

(87) PCT Pub. No.: WO99/16551

PCT Pub. Date: Apr. 8, 1999

(30) Foreign Application Priority Data

Oct. 1, 1997 (DE) ..... 197 43 477

(51) Int. Cl.[7] ..... A47K 3/28; E03C 1/05

(52) U.S. Cl. ..... 239/444; 239/578; 4/605; 4/623

(58) Field of Search ..... 239/436, 443, 239/444, 446, 569, 578; 4/623, 615, 605, 604, 596

(56) References Cited

U.S. PATENT DOCUMENTS

| | | | | |
|---|---|---|---|---|
| 4,394,969 | * | 7/1983 | Jette | 239/578 X |
| 4,696,428 | * | 9/1987 | Shakalis . | |
| 4,729,135 | * | 3/1988 | Titterington | 239/587 X |
| 5,121,511 | * | 6/1992 | Sakamoto et al. | 4/615 X |
| 5,199,639 | * | 4/1993 | Kobayashi et al. | 239/436 X |
| 5,414,879 | * | 5/1995 | Hiraishi et al. | 4/605 X |
| 5,853,130 | * | 12/1998 | Ellsworth | 239/444 X |

FOREIGN PATENT DOCUMENTS

| | | | |
|---|---|---|---|
| 3-23822 | * | 3/1991 | (JP) . |
| 6-108503 | * | 6/1994 | (JP) . |

* cited by examiner

*Primary Examiner*—Lesley D. Morris
(74) *Attorney, Agent, or Firm*—Pendorf & Cutliff

(57) ABSTRACT

The invention relates to a shower system with a showerhead (18) which is connected to a mixer faucet (12) for warm and cold water via a water delivery channel (16) and can be operated with various, according to selection, streams. According to the invention, a remote control unit is provided for adjusting the stream of the showerhead in order to enable an easier and more reliable change of the stream. To this end, an actuating element is located at a distance from the showerhead.

10 Claims, 4 Drawing Sheets

18
16
46
44
40
42
38
14
10
12
26
48
50
52
54
20
22
58
56
60

SHOWER SYSTEM WITH ADJUSTABLE STREAMS

BACKGROUND OF THE INVENTION

1. Field of the Invention

The invention concerns a shower system including a showerhead connected to a water supply channel with a mixer valve for hot and cold water, and selectively operable with adjustable stream types.

2. Description of Related Art

In showerheads, provisions are often made to enable an adjustment of the water stream, for example the adjustment to a wide spray stream, a soft stream, or a hard massage stream. In order to accomplish this adjustment, an adjustment device is provided in the showerhead in which, upon operation, varying jets or opening groups are acted upon with shower water. The operation of the adjustment device always occurs at the showerhead, usually by rotation of an adjustment device in the outlet area of the water stream or by operation of an adjustment lever extending through the showerhead. This type of showerhead with various adjustment devices and operation means are known for example from DE-PS 26 09 557, DE-OS 34 13 552, DE-OS 26 44 765, and DE-OS 25 58 796.

In the known showerheads, it has been found to be a disadvantage, that the user, in order to change the type of stream, in certain cases must reach through the water stream to the showerhead. Further, the user is confronted at this time with multiple separate adjustment devices for the water flow volume and the water temperature at the shower wall and for the adjustment of the type of stream at the showerhead.

SUMMARY OF THE INVENTION

The invention thus is based upon the objective, of providing a shower system, in which the manipulation of the adjustment of the stream type is simplified.

The invention is based above all on the idea, that the adjustment of the type of stream is easier and more reliable to accomplish, when the adjustment device in the showerhead need not be operated directly at the showerhead itself. In accordance with the invention, a device for remote operation of the device for adjustment of the type of stream from the showerhead is provided. In particular, it is envisioned in accordance with the invention to provide an operating means for adjustment of the stream type in the showerhead remote from the showerhead. By the spatial separation of showerhead and operating means for adjustment of the stream type, it is possible to adjust the stream type without having to reach through the water stream. This simplifies the operation and allows the user a simplified achievement of the various stream types during adjustment.

In an advantageous embodiment of the invention, the shower system includes a push-pull or rotation type adjustment device provided at the showerhead for adjustment of the stream to the desired type, an operation means, and a final control element operatively connected with the operation means for transmitting control force from the operating means to the adjustment device. The operating means is thereby preferably provided in the area of the water mixture valve in a wall-mounted control housing.

Preferably, the water supply channel is constructed as flexible hose or as tube, in which the final control element is provided in a watertight jacket.

According to a preferred embodiment of the invention, the final control element is formed as a mechanical final control element, preferably as a Bowden control cable in flexible steel conduit, or a push rod, or flexible shaft. Since with Bowden control cables only pull forces can be transmitted, one Bowden control cable is provided for each adjustment direction. In comparison, with a push rod or flexible shaft final control element, both pull as well as push forces can be transmitted.

The adjustment device can include a push mechanism with a push element guided in a push housing, and the final control element can include two Bowden control cables secured to the push element at oppositely lying ends. Preferably the push element includes, for the facilitation of the selection of positions associated with various types of streams, an arresting element which works in cooperation with an index or arrestor provided in the showerhead.

Alternatively the adjustment device can be a rotation mechanism with a rotation element rotatably mounted in the showerhead, and the control device can include two Bowden control cables engaging the rotation element on oppositely lying sides. Also in this case the rotation element includes an index element to facilitate adjustment to defined positions corresponding to the various stream types, preferably working in cooperation with an indentation array provided in the showerhead.

In the preferred embodiment of the invention, the operating element is formed as a control lever provided in a wall-mounted control housing and pivotable in its central area about an axle, which on its one end has an adjustment knob, and on its other end is connected to the final control element. The control housing is preferably provided in the area of the mixture valve, so that the user finds the adjustment possibility for the water amount and temperature as well as the stream type conveniently located immediately adjacent to each other. In the case of the transmission of the control force using Bowden cables, there can in the control housing be provided a turn-around or redirection roll for one of the two Bowden cables so that during change in position of the adjustment device of the showerhead the Bowden cables are respectively operable to be pulled in both adjustment directions.

Alternatively to the mechanical control transmission, the final control element can include a hydraulic control force transmission circuit or channel. The adjustment of the type of stream then occurs via water pressure, wherein the necessary water pressure is either provided by the shower water itself or preferably via a separate water connection. The final control element can then, on the side of the showerhead, include two hydraulic pistons, each one respectively in a pressure transmission channel, and connected via a rod element with the adjustment device. On the operation side, the final control element can include two throttle valves in separate pressure conduit, which by means of the operating mechanism selectively open or close the appropriate pressure conduit, so that the control force for producing the various stream types is transmitted to the adjustment device.

A further preferred design of the invention envisions that the control of the type of stream occurs via an electro-motor drive. This can occur via an electro motor drive provided in the control housing whereby the operating means is designed as an electrical switch with a number of selection possibilities corresponding to the number of types of stream. Alternatively a low voltage electro-motor for operation of the adjustment device can be provided in the showerhead. In this case, the final control element is preferably designed as a, preferably in the shower water line guided, electrically insulated low volt circuit and the operating mechanism is an electrical switch with a number of switch positions corresponding to the number of stream types.

The electro-motor can also he operated via a remote control device provided in the control housing. The remote control device can herein include a transmitter for radio, infrared, or ultra-sound signals, and the electro motor can be provided with a corresponding receiver device, which converts the remote control signal into electrical control impulses for the electro-motor.

The operating mechanism in the control housing can be designed as an acoustic sensor, so that the conversion or adjustment of the stream type can be caused by an acoustic input, for example voice control. Alternatively, the operating means can be designed as a movement sensor incorporated in the control housing, preferably using infrared sensors, so that the adjustment of the stream type can be brought about by gesturing.

In accordance with a preferred further development of the invention, a wall-mounted control panel is provided with final control elements for adjustment of the stream type as well as water temperature and flow amount. This provides an integrated solution with which the user finds the various adjustment possibilities in a single control panel with easy overview. The control panel can include a liquid crystal type display, by means of which the instantaneous condition and/or the preset values for the water temperature, the flow strength and/or the stream type can be displayed. The control panel should in that case include selection elements for adjustment of input values for the water temperature, the flow strength, and the stream type.

BRIEF DESCRIPTION OF THE DRAWINGS

In the following, the invention will be described in greater detail on the basis of the embodiments represented in the drawings. There is shown FIGS. 1*a–e* A first exemplary embodiment of the shower system with mechanical adjustment possibility for the stream type.

DETAILED DESCRIPTION OF THE INVENTION

Figures 1A, 1C, 1D, 1E:
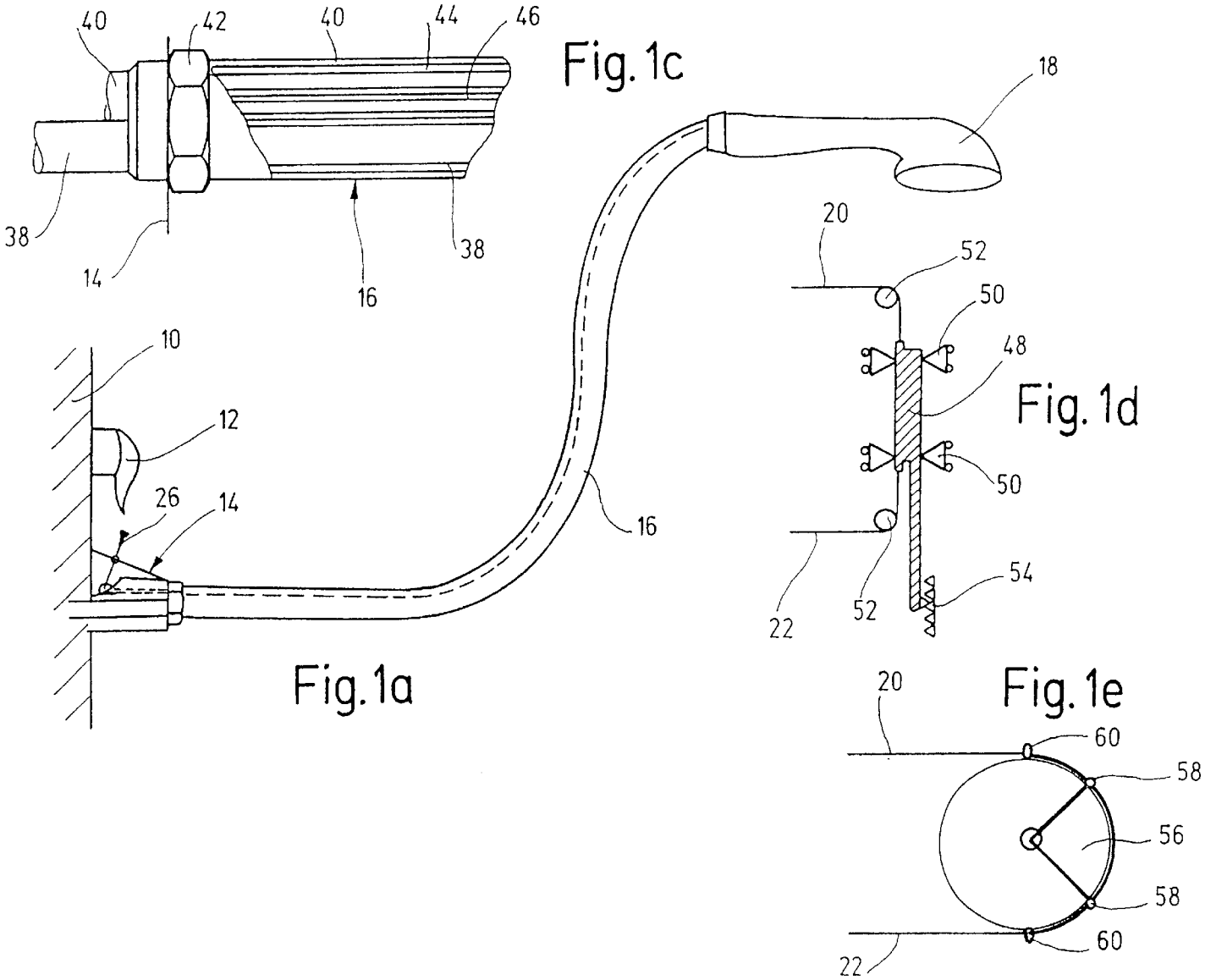

In the shower system shown schematically in FIG. 1, the adjustment of the stream type occurs mechanically by means of two Bowden cables. In a wall 10 of the shower, a single lever mixer 12 and a control housing 14 are mounted. On the control housing 14 a combination-hose 16 is secured, in which on the one hand the final control element for the showerhead 18 is guided and through which on the other hand the shower water flows.

Figure 1B:
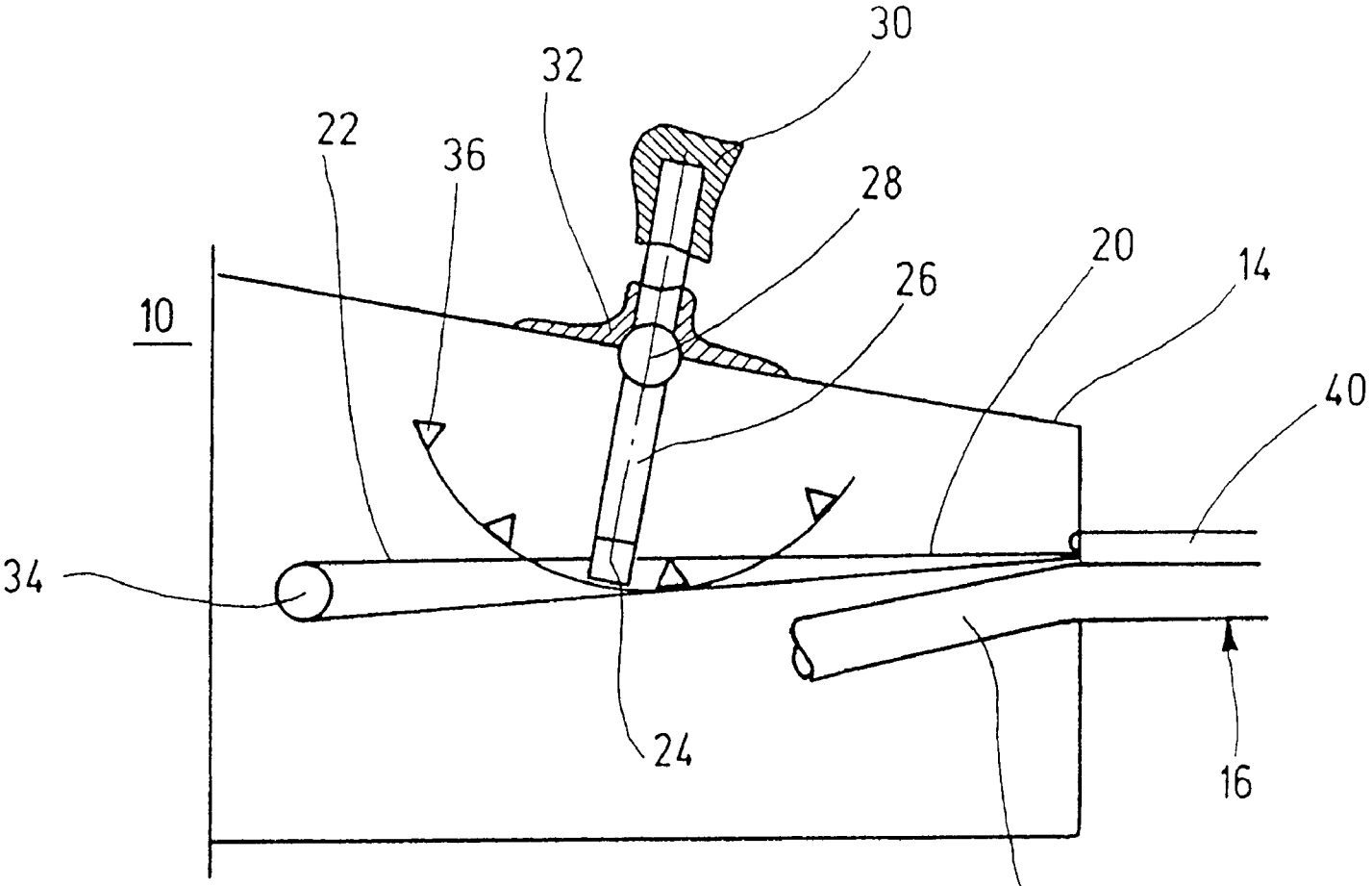

FIG. 1*b* shows schematically the construction of the control housing 14. Two Bowden cables 20, 22 are secured to the lower end 24 of a control lever. The control lever 26 is pivotably mounted in a housing fixed rotation mount 28 and is provided on its operating side with a control knob 30. The passageway for the control lever 26 in the control housing 14 is closed off watertight by seal 32. In the inside of the control housing 14, there is provided a turn-around or redirection control 34, about which the one Bowden cable 22 is guided, so that during pivoting of the control lever 26 respectively one of the Bowden cables 20, 22 is caused to be pulled. A notch or arrest device 36 exhibits a number of notches or stops for the control lever 26 corresponding to the number of stream types which can be selected. The combination hose 16 guided in the control housing 14 contains a water hose 38 as well as a Bowden control hose 40.

The construction of the combination hose 16 is shown in greater detail in FIG. 1*c*. For securing the combination hose 16 to the control housing 14 and to the showerhead (not shown) there is respectively one screw cap or sleeve nut 42 secured to a hose thread connected to the combination hose 16. In the inside of the combination hose 16 are guided the water hose 38 and the Bowden control cable 40. The water hose 38 is connected to the water lines in a conventional manner not shown in greater detail. In the inside of the Bowden control cable 40 are provided two guide jackets 44, 46 for the Bowden cables 20, 22, so that the Bowden cables 20, 22 during the operation of the control lever 26 cannot rub against each other.

The operation of the control device in the showerhead 18 is schematically shown in FIGS. 1*d* and *e*.

In a shower with a push mechanism for water stream adjustment (FIG. 1*d*) a push element 48 is guided in a push housing 50. The Bowden cables 20, 22 are connected to the push element 48 at oppositely lying ends via redirection pulleys 52. During operation of the control lever 26, one of the Bowden cables 20, 22 is respectively caused to be pulled and thereby pulls the final control element 48 into a corresponding position. For the precise fixing of the various positions of the push element, which correspond to the various stream types, the push element includes a detent or notch mechanism 54.

In an adjustment device with a rotation mechanism (FIG. 1*e*), the adjustment of the stream type occurs via a rotation element 56. The Bowden cables 20, 22 are connected to adjustment horns 58 of the rotation element 56. The end positions of the adjustment range of the rotation element 56 are fixed by end stops 60. The rotation mechanism can likewise include a not-shown arresting mechanism for precise determination of the selection positions.

Figure 2A:
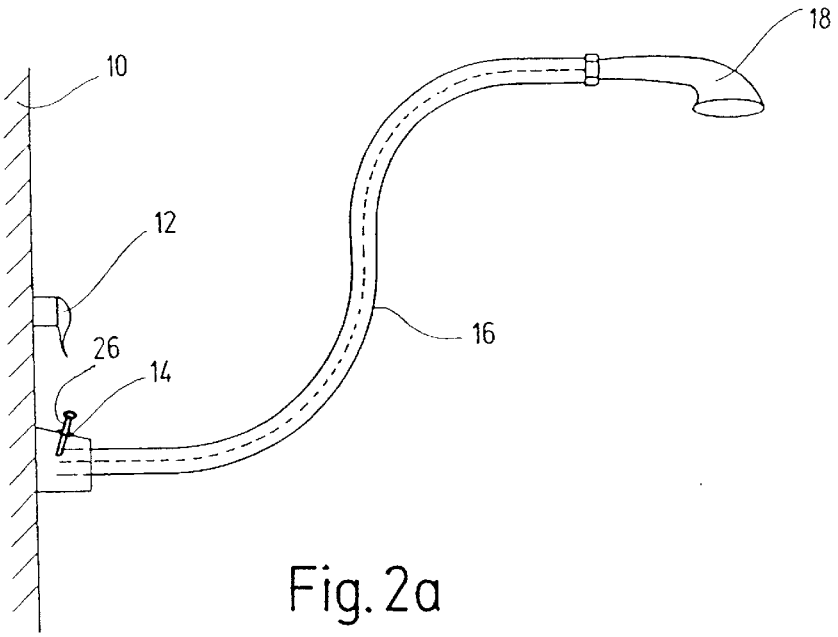
FIGS. 2*a–c* An exemplary embodiment of a shower system with hydraulic adjustment for the stream type.
Figure 2B:
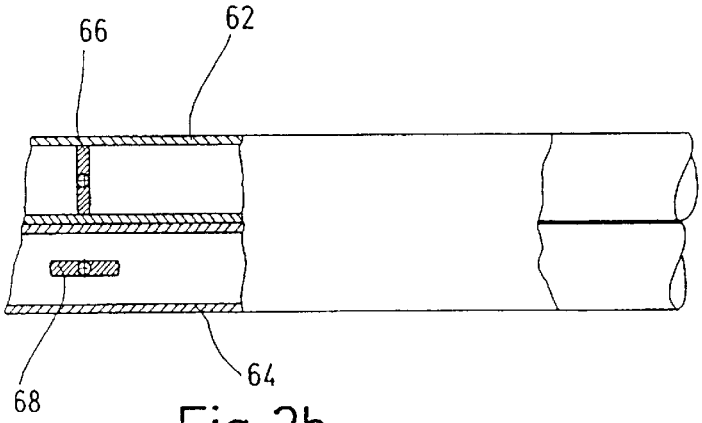
Figure 2C:
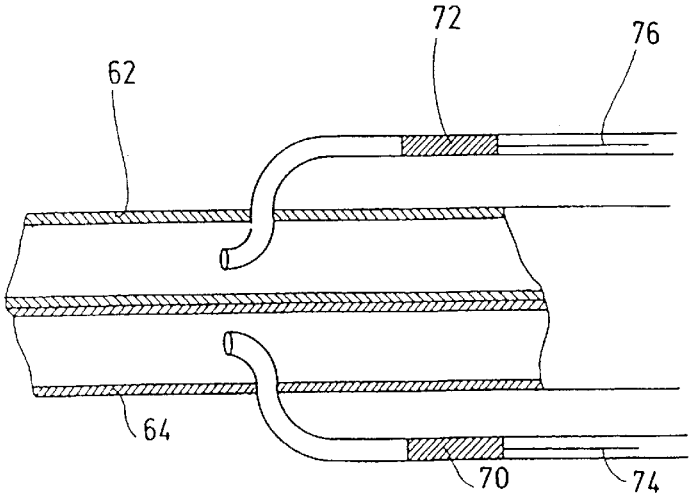

In FIGS. 2*a* through *c*, an adjustment device is shown, in which the control force is transmitted hydraulically. FIG. 2*a* corresponds substantially with FIG. 1*a*. The combination hose 16 contains here however, besides the water conduit, two separate hydraulic hoses 62, 64 which in the area of their operating end respectively include a throttle valve 66, 68. The throttle valves 66, 68, are operated in a manner not shown in detail by the control lever 26 and can so be brought into a flow-through cross section opening or closing position. Therewith three switch positions can be realized, in which either the hose 62 or the hose 64 or both hoses are acted upon by pressure. At the showerhead end of the combination hose 16, there are two pressure head pistons 70, 72 (FIG. 2*c*), which by means of rod elements or flexible shafts 74, 76 are connected with the adjustment device of the showerhead. The adjustment device can here be designed as push mechanism or as rotation mechanism.

Figure 3:
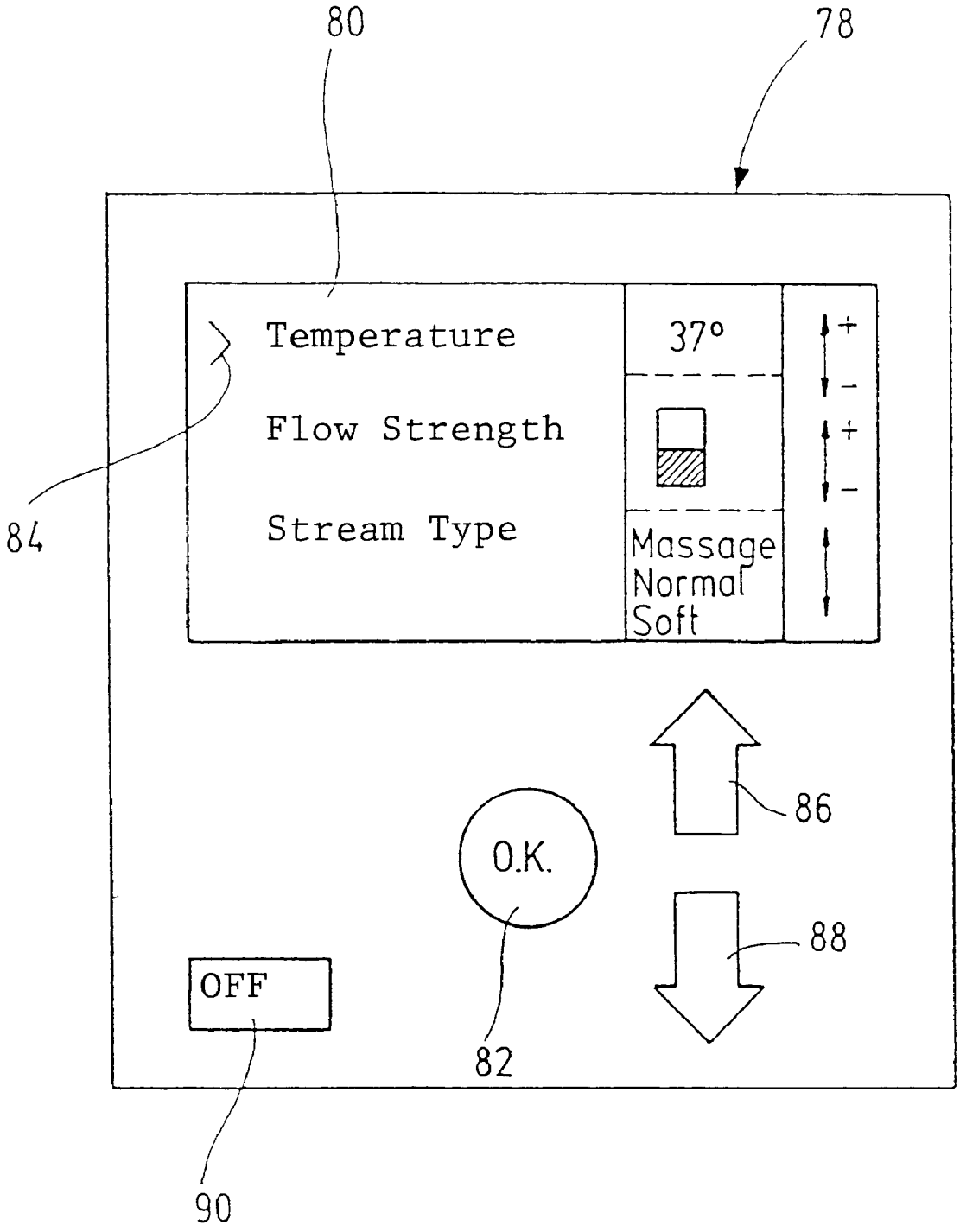
FIG. 3 A schematic representation of a control panel with adjustment possibilities for the stream type as well as the water temperature and flow amount.

FIG. 3 shows a control panel 78, in which the adjustment possibilities for the type of stream and water temperature and amount are combined into a single functional unit. The control panel 78 has a display field 80, which is essentially divided into three display areas. In the left area of the display field, the possibilities to be adjusted are shown, including the water temperature, the stream intensity, and the stream type. In the middle area of the display field 80, the instantaneous values of the control values, or also input values in the sense of an intended value/actual control value, is represented. In the right field of the display field 80, the selection possibility for the respective parameters is shown. Below the indication field 80 there is a further switch. The button 82 inscribed with OK serves as confirmation button, which is activated, when the respective selected values correspond to the desires of the user. Upon operation of the button 82, the adjustment mark 84 in the left area of the display field 80 jumps to the next adjustment value, which then can be adjusted according to the wish of the user. The change of the respective regulation or control valves occurs by the arrow buttons 86, 88 with which a higher or lower temperature, a more or less strong water stream and the various stream types can be selected. For confirmation of the respective selected values, the button 82 can be employed, whereby supplementally the adjustment mark 84 is moved to the next adjustment setting. For safety purposes, in order to prevent for example a scalding in the case of selection of too high of a water temperature, an emergency cut-off switch 90 is provided, which causes an immediate interruption of the water flow.

In summary, the following is to be concluded: The invention relates to a shower system with a showerhead 18 which is connected to a mixer valve 12 for warm and cold water via a water delivery channel 16 and can be operated with various streams which can be selected. According to the invention, a remote control unit is provided for adjusting the stream of the showerhead in order to enable an easier and more reliable selection of the stream type. To this end, an operatng element is located at a distance from the showerhead.

What is claimed is:

1. A shower system including:

a showerhead connected to a water supply channel and selectively operable with various types of streams;

a mixing valve provided between said water supply channel and said shower head, said mixing valve for selecting warm and cold water;

a control means provided at a distance from the showerhead for adjustment of the stream type of the showerhead;

an adjustment device provided in the showerhead with which the shower stream is adjusted to the desired stream type via a push-pull or rotation movement, and a final control element which transmits control force from the control means to the adjustment device;

wherein the final control element includes hydraulic control-force transmission segments which are acted upon by water under pressure from the water supply channel, and wherein the final control element includes two hydraulic pistons, each one respectively provided in one of said hydraulic control-force transmission segments and connected to the adjustment device via a rod element.

2. A shower system according to claim 1, wherein said control means comprise a wall-mounted control panel with control input elements for adjustment of the stream type as well as the water temperature and flow amount.

3. A shower system according to claim 2, wherein said control panel includes a display device via which the instantaneous condition values and/or the selected inputs for the water temperature, the stream strength, and/or the stream type are selectable.

4. A shower system according to claim 3, wherein the display device is a liquid crystal display or a LED display.

5. A shower system according to claim 1, wherein the water supply channel is a flexible hose or a pipe, within which the final control element is provided in a water-tight jacket.

6. A shower system including a showerhead connected to a water supply channel and selectively operable with various types of streams;

a mixing valve provided between said water supply channel and said shower head, said mixing valve for selecting warm and cold water, a control means provided at a distance from the showerhead for adjustment of the stream type of the showerhead, an adjustment device provided in the showerhead with which the shower stream is adjusted to the desired stream type via a push-pull or rotation movement, and a final control element which transmits control force from the control means to the adjustment device, wherein the final control element includes hydraulic control-force transmission segments which are acted upon by water under pressure from the water supply channel, and wherein the final control element further includes two throttle valves provided respectively in said hydraulic control-force transmission segments, which are selectively operable via the control means to open or close the appropriate hydraulic control-force transmission segment so that a control force for producing the various stream types can be transmitted to the adjustment device.

7. A shower system according to claim 6, wherein said control means comprise a wall-mounted control panel with control input elements for adjustment of the stream type as well as the water temperature and flow amount.

8. A shower system according to claim 7, wherein said control panel includes a display device via which the instantaneous condition values and/or the selected inputs for the water temperature, the stream strength, and/or the stream type are selectable.

9. A shower system according to claim 8, wherein the display device is a liquid crystal display or a LED display.

10. A shower system according to claim 6, wherein the water supply channel is a flexible hose or a pipe, within which the final control element is provided in a water-tight jacket.

* * * * *